US005604997A

United States Patent [19]

Dieter

[11] Patent Number: 5,604,997

[45] Date of Patent: Feb. 25, 1997

[54] SHOE UPPER AND METHOD OF MAKING SAME

[75] Inventor: William M. Dieter, Portland, Oreg.

[73] Assignee: Nike, Inc., Beaverton, Oreg.

[21] Appl. No.: 393,487

[22] Filed: Feb. 24, 1995

[51] Int. Cl.[6] ..... A43B 23/00; A43D 11/00

[52] U.S. Cl. ..... 36/45; 36/47; 36/48; 12/146 C

[58] Field of Search ..... 12/146 C, 142 G, 12/142 MC, 146 D; 36/45, 47, 48, 49, 11, 77 R

[56] References Cited

U.S. PATENT DOCUMENTS

| | | | |
|---|---|---|---|
| 159,991 | 2/1875 | White | 36/77 R |
| 249,467 | 11/1881 | Hally | 36/77 R |
| 983,576 | 2/1911 | Smith | 36/48 |
| 1,104,357 | 7/1914 | Hassel . | |
| 1,201,927 | 10/1916 | Blum . | |
| 1,258,024 | 3/1918 | Laybourn . | |
| 1,803,789 | 3/1931 | Burgess . | |
| 2,147,197 | 2/1939 | Glidden | 36/45 |
| 2,210,475 | 8/1940 | Trimble . | |
| 2,256,643 | 9/1941 | Hosker | 36/45 |
| 2,276,582 | 3/1942 | Krevis . | |
| 2,444,822 | 7/1948 | Griffin . | |
| 2,552,802 | 5/1951 | Martin | 36/47 |
| 2,645,042 | 7/1953 | Stritter | 36/11 |
| 2,974,427 | 3/1961 | Wolff . | |
| 3,057,086 | 10/1962 | Rigsby . | |
| 3,058,241 | 10/1962 | Rigsby | 36/11 |
| 3,289,328 | 12/1966 | Abel . | |
| 3,289,330 | 12/1966 | Trachsel et al. | 36/11 |
| 3,762,075 | 10/1973 | Munschy . | |
| 3,811,682 | 5/1974 | Neale et al. . | |
| 3,878,638 | 4/1975 | Benjamin . | |
| 4,033,068 | 7/1977 | Skillman . | |
| 4,176,475 | 12/1979 | Arcamonte . | |
| 4,235,453 | 11/1980 | Lawson et al. . | |
| 4,237,516 | 5/1982 | Labozynski . | |
| 4,413,431 | 11/1983 | Cavanagh | 36/45 |
| 4,532,653 | 8/1985 | Riaboff . | |
| 4,616,428 | 10/1986 | Leger . | |
| 4,914,308 | 3/1980 | Karlsson . | |
| 4,922,059 | 5/1990 | Walker et al. . | |
| 5,185,944 | 2/1993 | Okajima . | |
| 5,345,638 | 9/1994 | Nishida | 36/45 |

FOREIGN PATENT DOCUMENTS

| | | | |
|---|---|---|---|
| 4016217 | 11/1991 | Germany | 36/48 |
| 5176804 | 7/1993 | Japan | 36/48 |
| 10329 | 3/1895 | Switzerland . | |
| 155747 | 12/1920 | United Kingdom . | |
| 1539886 | 2/1979 | United Kingdom | 36/49 |
| 2022223 | 12/1992 | WIPO | 36/47 |

*Primary Examiner*—Marie D. Patterson
*Attorney, Agent, or Firm*—Banner & Witcoff, Ltd.

[57] ABSTRACT

The invention is directed to a shoe upper formed from a blank of material. The upper has a toe portion, a pair of side portions, a heel portion, and a bottom portion. The bottom portion of the upper is formed from the blank by folding the blank about a fold area in the heel portion such that the bottom portion can be connected to the bottom of the toe portion, the bottoms of the pair of side portions, and the bottom of the heel portion. The blank has a first section which includes the toe portion, side portions and heel portion. The blank also has opposite ends. The opposite ends of the blank are connected to one another to form the toe portion, side portions and heel portion of the upper. The shoe upper may also be formed from a blank having a second section which includes the bottom portion of the upper, and further may include one or more wing portions which overlie generally the side portions of the upper.

21 Claims, 6 Drawing Sheets

SHOE UPPER AND METHOD OF MAKING SAME

BACKGROUND OF THE INVENTION

1. Field of the Invention

The present invention is directed to a shoe upper made from a blank of material by folding and stitching the blank.

2. Description of the Prior Art

Generally, numerous shoe constructions are known wherein the shoe upper or the entire shoe itself is made from a blank of material by folding and stitching the blank in a particular way. For example, one type of shoe upper or shoe-like construction involves the use of a single, generally symmetrical blank wherein the bottom of the shoe upper or shoe construction is situated in the general center of the blank. The toe, side and heel portions of the shoe structure are positioned generally around the bottom portion. The toe portion is located on the opposite side of the bottom portion than the heel portion, and one side portion is located on the opposite side of the bottom portion than the other side portion. The shoe structure is created by generally folding the side portions, heel portion and toe portion upward and stitching them appropriately such that a shoe-like or shoe upper construction is formed. The shoe upper formed can then be attached to a shoe sole.

U.S. Pat. Nos. 1,104,357 and 2,974,427 are exemplary of this slipper-style shoe construction. This type of construction is not conducive to performance footwear because it does not allow for fit-adjustment of the upper. Also, these patents necessarily require lasting to generate a shape that will accommodate the foot of the wearer.

Another type of shoe-like construction made from a blank of material is illustrated by U.S. Pat. No. 4,194,308. This reference discloses a shoe construction wherein a blank of material is formed such that generally one half of the shoe construction is formed on one side of the blank and the other half of the shoe construction is formed on the other side of the blank. The shoe construction is formed by generally folding the blank upon itself and stitching the bottom and toe portion edges together to form a foot enclosure. Thus, a seam runs centrally along the bottom of the shoe structure around the toes and over the top portion of the foot. This shoe construction is disadvantageous because the stitch line located on the bottom of the shoe construction can interfere with the attachment of the shoe structure to a sole. The centrally located stitch line may further be a source of discomfort and irritation to a shoe wearer along both the bottom and top of the foot.

U.S. Pat. No. 3,289,328 shows a method of constructing a sock from a blank. This construction method involves an asymmetrical blank wherein the side portions, heel portion and toe portion of the shoe construction are formed by wrapping the blank and stitching two opposite edges of the blank together. The bottom portion of the sock is generally connected to one side portion of the sock such that when the side portions, heel portion and toe portion are formed, the bottom portion can be formed by folding it upward in a direction that is generally perpendicular to the longitudinal center line of the sock and by stitching the bottom portion to the formed toe portion, heel portion and other side portion. The blank of material is generally asymmetrical and has the bottom portion integral with what appears to be the portion of the blank which forms one side of the sock. Notably, the seams are butt jointed or felled in constructing the sock, in turn creating a slight amount of excess material in the area of the seams. This sock construction is thus disadvantageous because the excess material in the area of the seams may cause irritation to the wearer.

SUMMARY OF THE INVENTION

The present invention is directed to a shoe upper formed from a blank of material. The shoe upper has a toe portion, a pair of side portions, a heel portion, and a bottom portion. One of the side portions is disposed adjacent one side of the toe portion and the other of the side portions is disposed adjacent the other side of the toe portion. One side of the heel portion is disposed adjacent the one side portion and the other side of the heel portion is disposed adjacent the other side portion. The bottom portion is formed by folding the blank about a fold area in the heel portion so that the bottom portion is disposed adjacent the bottom of the toe portion, the bottoms of the pair of side portions, and the bottom of the heel portion. A connecting means is used to connect medial and lateral sides of the bottom portion to the bottom of the toe portion, the bottoms of the pair of side portions, and the bottom of the heel portion. The blank has a first section which includes the toe portion, the side portions, and the heel portion, and opposite ends. The opposite ends of the first section are connected to one another to form the toe portion, the side portions and the heel portion of the upper.

A second section of the blank of the upper of the present invention may also be provided. This second section includes the bottom portion and at least one wing portion. The wing portion is disposed adjacent one side of the bottom portion and extends upwardly therefrom. The wing portion is disposed outside of one of the side portions of the upper.

The present invention is further directed to a blank of material for forming a shoe upper. The blank has a first section including a heel portion adopted to wrap around the heel of a wearer, medial and lateral side portions adopted to cover the medial and lateral sides of the foot of the wearer, and a toe portion adapted to cover the toes of the wearer. The blank also includes a second section extending from one side of the first section and including a bottom portion adapted to underlay the foot of the wearer. The bottom portion is generally in alignment with and extends from the heel portion of the first section. The blank further includes a fold area located between the heel portion and the bottom portion about which the first and second sections are folded to place the bottom portion in contact with the heel portion, the medial and lateral side portions, and the toe portion.

The present invention is further directed to a method of making a shoe upper from a blank of material. A blank of material is formed into a configuration having a first section and a second section. One end of the first section is connected to the other end of the first section to form a toe portion, a heel portion, and a pair of side portions of the upper. The second section is folded about a fold area in the area of the heel portion of the first section to juxtapose a bottom portion of the upper formed in said second section with the bottom of the toe portion, the heel portion, and the pair of side portions. The medial and lateral sides of the bottom portion of the second section are connected to the bottom of the toe portion, the bottom of heel portion and the bottoms of the pair of side portions of the first section to form a foot enclosing upper.

The present invention provides a simple and effective method for forming and manufacturing a shoe upper. More specifically, according to the present invention, a novel shoe upper is formed from a specially designed blank of material.

A novel method of manufacturing the upper from this blank of material is provided by the present invention. Fit adjustment is provided with this method, and lasting is not required to generate the shape of the upper. A number of folding and stitching operations are performed on the blank to form the upper. During these folding and stitching operations, the blank of the present invention may be continually maintained in a semi-flat condition. In this manner, automated stitching may advantageously be used in forming the upper. Because the folding and stitching operations are conducive to being performed by automated stitching machines, the manufacture of the shoe upper may be greatly simplified. More specifically, the use of automated stitching machines may significantly reduce labor costs. Additionally, all peripheral components of the shoe upper may advantageously be added to the blank before most of the folding and stitching operations take place. This eliminates the need for costly post-production operations on the manufactured upper.

In its flattened stage, the surface of the blank of material may receive printing or be compression molded. With printing, the use of non-decorative inks (rubber inks) may be utilized to enhance the performance of the blank of material. Decorative printing is also an option. Compression molding may be used in the same fashion as printing. However, compression molding allows for the fine tuning of the upper for individual sports activities by making suitable adjustments in the density of the foam inserted into the mold. Aesthetic detail may also be applied during the molding process. Further, because the blank of material forms the entire structure of the shoe upper, only one seam is required to close the upper. The possibility of seam blowout is thus significantly reduced.

BRIEF DESCRIPTION OF THE DRAWINGS

The novel features of the invention are set out with particularity in the appended claims, but the invention will be understood more fully and clearly from the following detailed description of preferred embodiments of the invention as set forth in the accompanying drawings, in which:

DETAILED DESCRIPTION OF THE PREFERRED EMBODIMENTS

Figure 1:
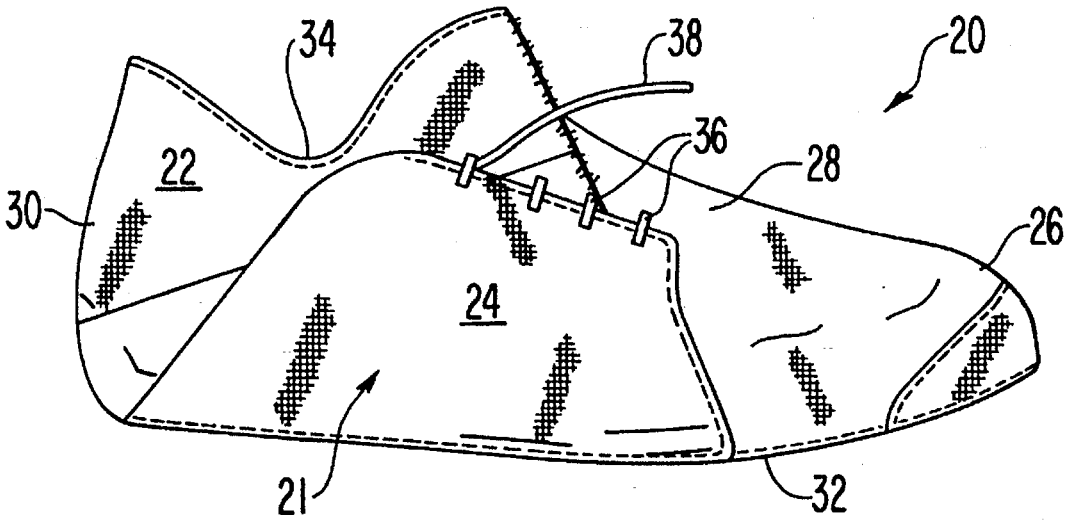
FIG. 1 is a lateral side view of the shoe upper of the present invention.

With reference to FIG. 1, a shoe upper 20 according to the present invention is shown. Upper 20 has an inner sleeve 22 and medial and lateral wing portions 24. Inner sleeve 22 generally has a toe portion 26, medial and lateral side portions 28, heel portion 30 and bottom portion 32. In the lateral side view of the upper 20 shown in FIG. 1, only the lateral wing and lateral side portions are shown. However, the medial wing and medial side portions are similarly disposed on the opposite side of the upper, i.e., on the medial side of the upper.

Inner sleeve 22 also has a throat 34 into which the foot of a shoe wearer may be inserted. Inner sleeve 22 can be made of any suitable material, for example, synthetic or natural leather. Preferably, the inner sleeve 22 is made of an elastic material, for example, neoprene, such that inner sleeve 22 conforms to and snugly fits the shape of the foot of a wearer.

Medial and lateral wing portions 24 are generally disposed to the outside of medial and lateral side portions 28 of inner sleeve 22, respectively. Each of these wing portions 24 has eyelets 36 disposed adjacent its upper edge. A lace 38, may be disposed in eyelets 36 such that when the lace is tightened, wing portions 24 are drawn towards the center and across the top of the foot such that the shoe upper is tightened about the foot. Wing portions 24 may be made of any suitable upper material, for example, synthetic or natural leather. Preferably, the wing portions 24 are made of a substantially inelastic material such that they may be tightened effectively about inner sleeve 22 and thus about the foot of the wearer.

Figure 2:
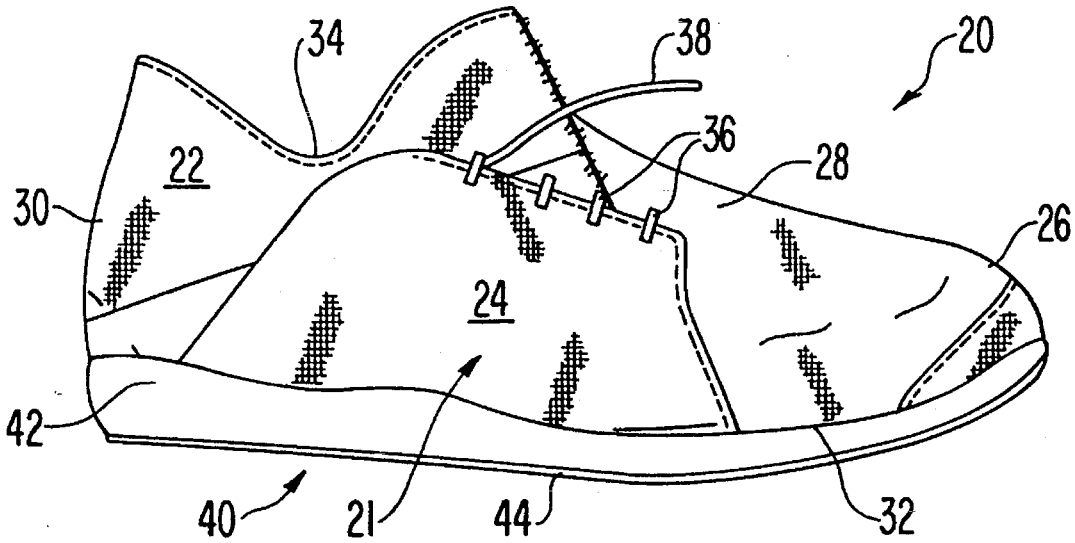
FIG. 2 is a lateral side view of the shoe upper shown in FIG. 1 attached to a sole.

With reference to FIG. 2, upper 20 is shown attached to sole 40. The sole 40 can be of a conventional type having a shock absorbing midsole 42 and a wear-resistant outsole 44. The upper 20 can be attached to the sole 40 in any suitable manner, for example, by a suitable adhesive or by stitching. The upper 20 would normally be attached to the sole 40 by spreading a suitable adhesive along the top of midsole 42 and positioning the bottom portion 32 of inner sleeve 22 and the lower portions of medial and lateral wing portions 24 along the top surface of the midsole 42. Thus, the bottom portion 32 of inner sleeve 22 will be securably attached to the sole 40 as will the lower edge of the medial and lateral wing portions 24.

The shoe of FIG. 2 can effectively and securely be positioned on the foot of a wearer. A wearer inserts his or her foot through throat 34 and into inner sleeve 22. Inner sleeve 22 completely surrounds and envelops the wearer's foot. Medial and lateral wing portions 24 are then tightened inward and across the top of the foot by lace 38. Medial and lateral wing portions 24 can have other suitable structures disposed along their upper edges for tightening the portions about the foot. For instance, a series of fasteners and straps can be used to bring portions 24 inward and secure them about the foot. The structure of upper 20 can be particularly effective in securing the shoe to the foot and providing wearer comfort if the inner sleeve 22 is made out of an elastic material and wing portions 24 are made out of a substantially inelastic material. With such a structure, the inner sleeve 22 will conform to and securely hug the foot. Inelastic wing portions 24, which are secured to sole 40, will provide firm structure for securing a wearer's foot when wing portions 24 are tightened around the side portions 28 of inner sleeve 22 and across the top of the foot by a tightening lace 38. Thus, the structure offers comfort and snugness by providing an elastic inner sleeve 22, and also offers firmness and semi-rigidity in the areas of the foot where needed because of the tightening of the inelastic wing portions 24 about the inner sleeve 22.

Figure 3:
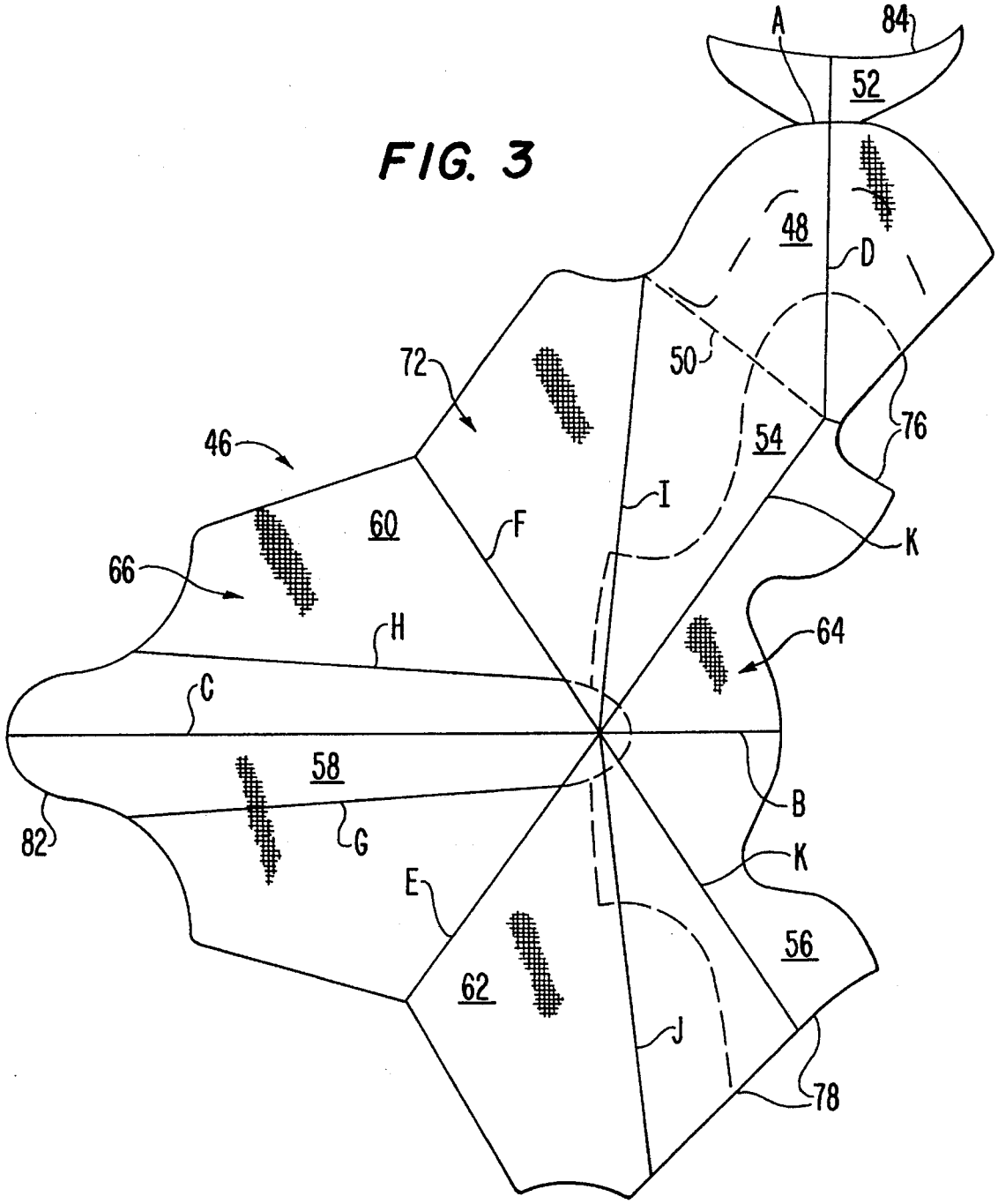
FIG. 3 is a plan view of the blank of material used in the present invention to construct the shoe upper shown in FIGS. 1 and 2.

Upper 20 is formed by folding and stitching a substantially flat blank of material in the manner described below. With reference to FIG. 3, a blank 46 used to make the upper 20 is shown. Blank 46 has a top surface 72 which will form the outer surface 21 of upper 20. Blank 46 also has bottom surface 74 (not shown in FIG. 3) which forms the inner surface of upper 20. Blank 46 may be formed by taking any suitable upper material, for example, natural or synthetic leather or other fabric, and cutting the material into the blank shape shown in FIG. 3. Blank 46 can be cut from a sheet of material by, for example, die cutting. Additionally, the material from which blank 46 is made may be compression molded prior to being cut into the shape of blank 46. In this regard, compression molding may be utilized to its fullest extent with the present invention because the upper is formed from a single piece of material. This is in contrast to traditional construction methods which involve piecing together many pieces of material. With conventional prior art methods, the many resulting seams rub against the foot of the wearer and cause discomfort. By combining a single piece construction with compression molding techniques in accordance with the present invention, an upper can be created that has extensive detail on the exterior while having a virtually seamless interior. This result is achieved when the upper is molded in a single cycle. With compression molding, it is also possible to insert a variety of different foam densities into the mold simultaneously.

After the blank 46 is cut into the shape shown in FIG. 3, the material may then have a particular pattern printed thereon. Since the upper is made from a blank 46, the pattern may be positioned to appear at a particular location on the shoe upper by simply printing the pattern on a particular portion of the blank. Additionally, once blank 46 is formed with the shape shown in FIG. 3, shoe upper components, for example, stripes or trademark insignia, may be added to blank 46. Because blank 46 is substantially flat, upper components may be easily stitched on the blank 46 such that when the blank 46 is folded into upper 20, the components will be positioned in the desired location on upper 20. The substantially flat structure of blank 46 allows the possibility of having the component stitched on blank 46 with an automated stitching process, thus possibly decreasing the manufacturing cost of the upper by decreasing labor costs.

With reference to FIG. 3, blank 46 has fold lines A, B, C, D, E, F, G, H, I, J and K. Blank 46 will be generally folded along these fold lines to form upper 20. For construction or production purposes, lines B, C, D and K are not absolutely required, but are used to facilitate the generation of the pattern on the blank 46. As discussed more fully below, the fold lines are defined as the blank 46 is placed on a pallet for automated stitching operations. Several of the fold lines may be used to define portions of the blank 46 which will correspond to the particular portions of upper 20. In this regard, the portions of blank 46 which correspond to the particular portions of upper 20 will be described with reference to FIG. 3.

Toe portion 26 of inner sleeve 22 is generally formed from blank toe portion 48. Blank toe portion 48 is the portion of blank 46 shown generally above dashed line 50 in FIG. 3. Blank toe portion 48 has a projection portion 52 which will be used to form a reinforcing toe section. Projection portion 52 is crescent shaped and has its lower edge generally defined by fold line A.

Medial side portion 28 and part of heel portion 30 of inner sleeve 22 will be formed from blank medial side and heel portion 54. Blank medial side and heel portion 54 is defined generally as the portion of blank 46 below dashed line 50, to the right of fold line I, and above fold line B.

Lateral side portion 28 and part of heel portion 30 of inner sleeve 22 will be formed from blank lateral side and heel portion 56. Blank lateral side and heel portion 56 is generally defined as the portion of blank 46 below fold line B, and to the fight of fold line J. Thus, portions 54 and 56 of blank 46 are generally used to form medial and lateral side portions 28 and heel portion 30 of inner sleeve 22 of upper 20.

With further reference to FIG. 3, bottom portion 32 of inner sleeve 22 of upper 20 is generally formed by blank bottom portion 58 of blank 46. Blank bottom portion 58 is generally formed on blank 46 in between fold lines G and H. The right-hand side of portion 58 in FIG. 3 is generally formed by the lower portion of fold line F and the upper portion of fold line E. Thus, blank bottom portion 58 is generally formed by fold lines G, H, F, E and their intersections.

Again with reference to FIG. 3, medial wing portion 24 of upper 20 is generally formed by blank medial wing portion 60. Blank medial wing portion 60 is defined as the portion of blank 46 generally above fold line H and to the left of fold line I. Lateral wing portion 24 of upper 20 is generally formed by blank lateral wing portion 62. Blank lateral wing portion 62 is generally formed by the portion of blank 46 that is below fold line G and to the left of fold line J.

As shown in FIG. 3, blank 46 may conveniently be divided into just two primary sections. Specifically, a first section 64 of blank 46 includes blank portions 48, 54, and 56. Thus, first section 64 generally contains the portions of blank 46 used to form toe portion 26, medial and lateral side portions 28, and heel portion 30 of inner sleeve 22 of upper 20. A second section 66 of blank 46 includes blank portions 58, 60, and 62. Thus, second section 66 includes the portions of blank 46 used to form bottom portion 32 of inner sleeve 22 and medial and lateral wing portions 24 of upper 20. First section 64 and second section 66 are generally divided along fold lines I and J with first section 64 being generally to the right of fold lines I and J in FIG. 3 and second section 66 being generally to the left of fold lines I and J.

Figure 4:
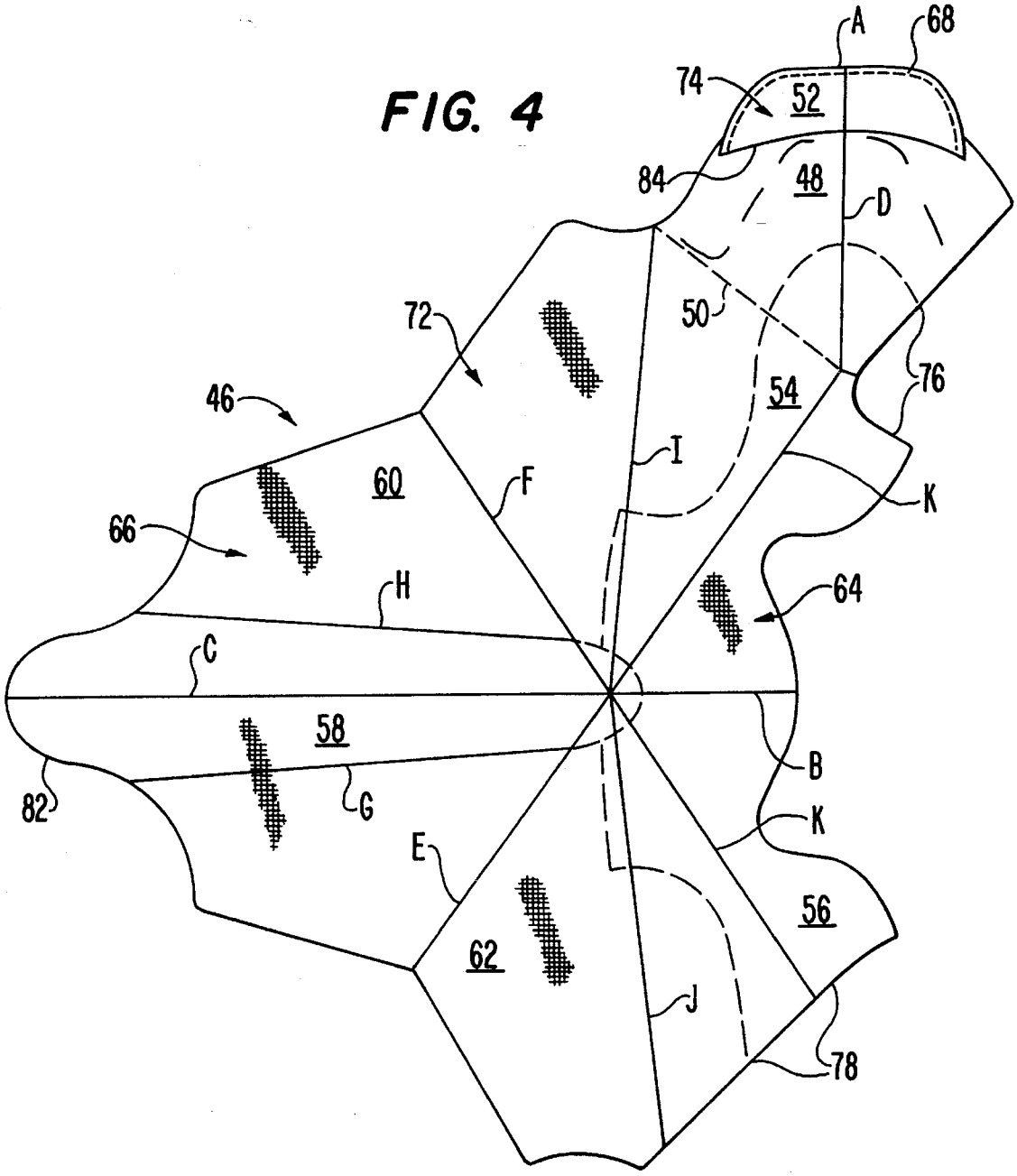
FIG. 4 is a plan view of the blank of material shown in FIG. 3 depicting a step in the construction of the shoe upper of the present invention.
Figure 5:
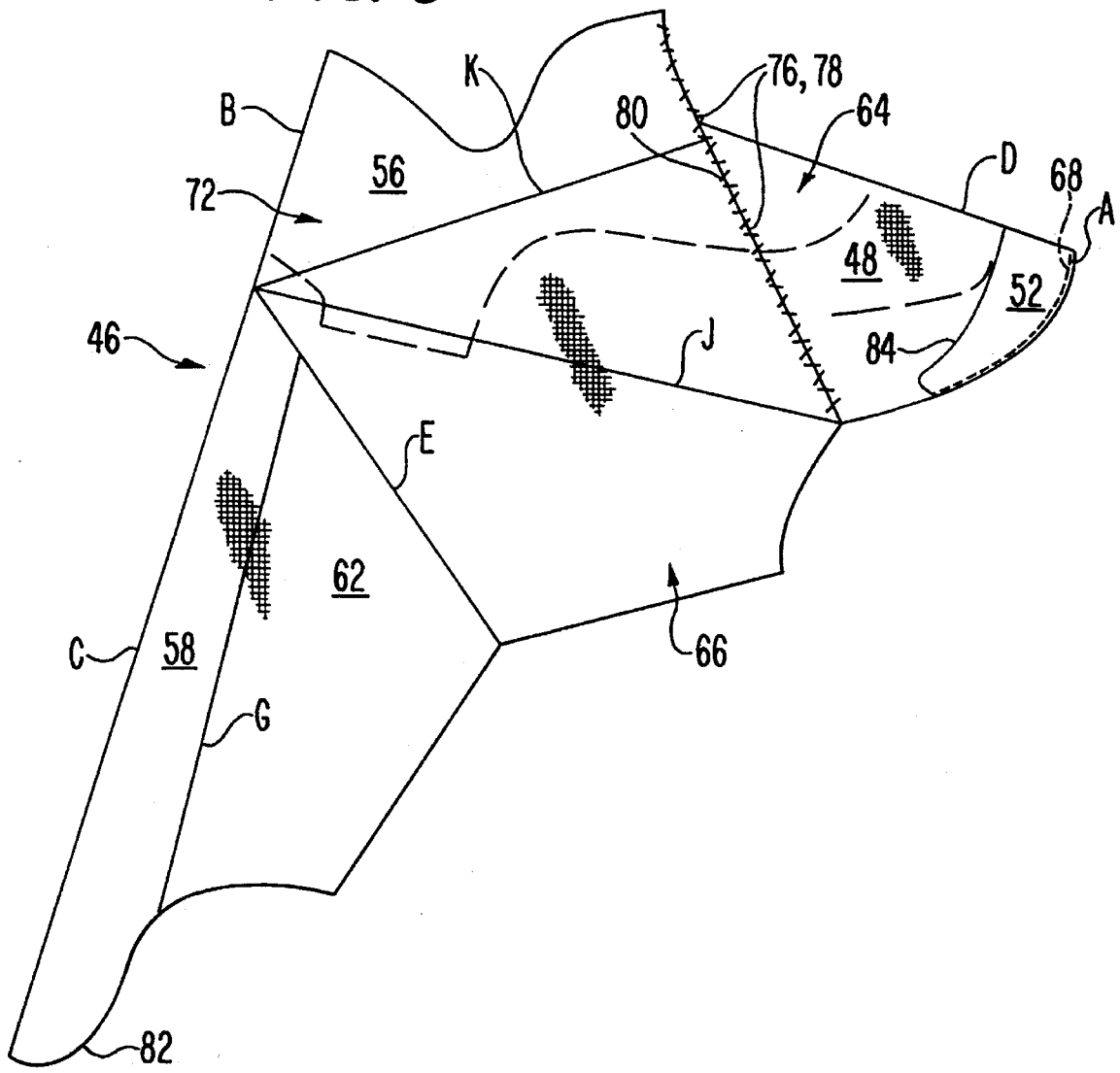
FIGS. 5, 6, 7, 8, and 9 depict the blank of material shown in FIG. 3 and show additional steps in the construction of the shoe upper of the present invention from a lateral side view.
Figure 6:
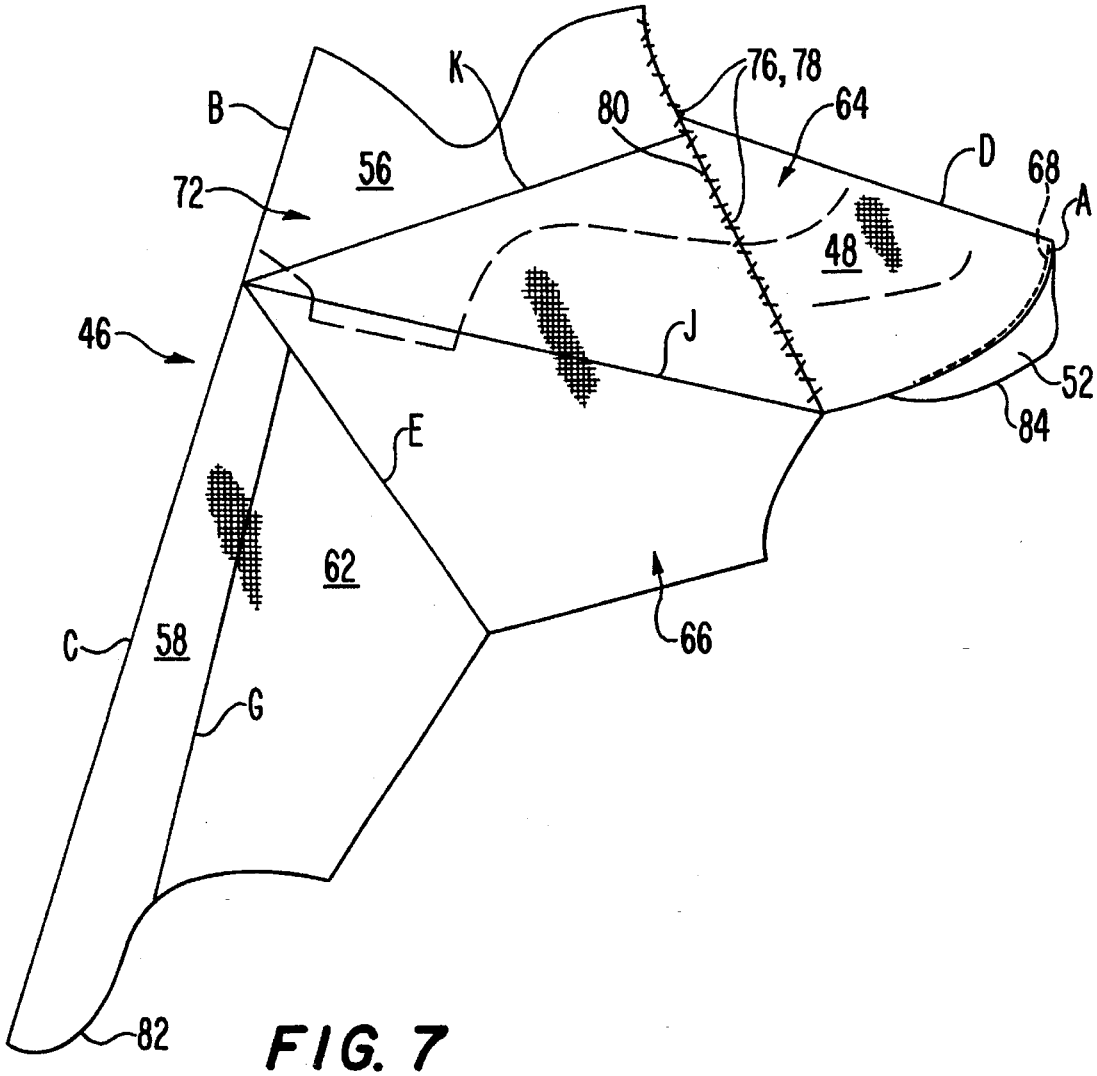

With reference to FIGS. 4–5, in order to form upper 20, projection portion 52 is folded along fold line A upwards and into an overlying relationship with blank toe portion 48. Projection portion 52 is then stitched to blank toe portion 48 by stitch line 68. As shown in FIG. 6, edge 84 is then double backed over stitch line 68, thus executing a "stitch and turn" operation. Edge 84 is now in position to be joined to edge 82 of blank bottom portion 58, as discussed more fully below with reference to FIGS. 7 and 8.

With further reference to FIG. 6, blank 46 is folded along fold lines B and C such that one half of blank bottom portion 58 is in an overlying relationship with the other half of blank bottom portion 58, such that blank wing portion 60 is in an overlying relationship with blank wing portion 62, and such that blank side and heel portion 54 is in an overlying relationship with blank side and heel portion 56. In this folded position, top surface 72 of blank 46 is to the outside and bottom surface 74 of blank 46 is to the inside. The blank 46 is then folded along fold line D such that one half of blank toe portion 48 is in an overlying relationship with the other half of blank toe portion 48. FIG. 6 shows the blank 46 of the present invention at this point in the formation of the upper, with fold lines E, G and J visible in a lateral side view of the upper 20 constructed from the blank 46. It should be noted that fold lines F, H and I are similarly disposed along the medial side of the upper 20 formed from the blank 46. Fold lines F, H and I are thus in substantial alignment with fold lines E, G and J respectively.

As shown in FIG. 3, first section 64 of blank 46 generally has opposite edges 76 and 78. Edge 76 is generally along the right side of blank toe portion 48 in FIG. 3 and also extends into a portion of blank side and heel portion 54. Edge 78 is generally along the lower portion of blank side and heel portion 56 in FIG. 3. With reference to FIG. 6, the folding operations described above bring edges 76 and 78 into an adjacent relationship. In this adjacent relationship, a zigzag stitch can be used to connect edge 76 to edge 78 along stitch line 80. As is apparent, any other suitable stitch or means can be used to connect edge 76 with edge 78, for example, an adhesive. The connection of edge 76 to edge 78 along stitch line 80 generally forms toe portion 26, side portions 28, and heel portion 30 of inner sleeve 22. As can be seen in FIG. 6, the blank in this folded position may be lying flat such that the stitching along stitch line 80 may be completed easily. It is possible to utilize an automated stitching machine to complete this stitching. Indeed, because the shoe is designed for such automated stitching, most construction steps may be accomplished with a conventional sewing machine. In order to maintain efficiency, a large bed automated stitching machine should be used to apply any pieces to the blank.

Figure 7:
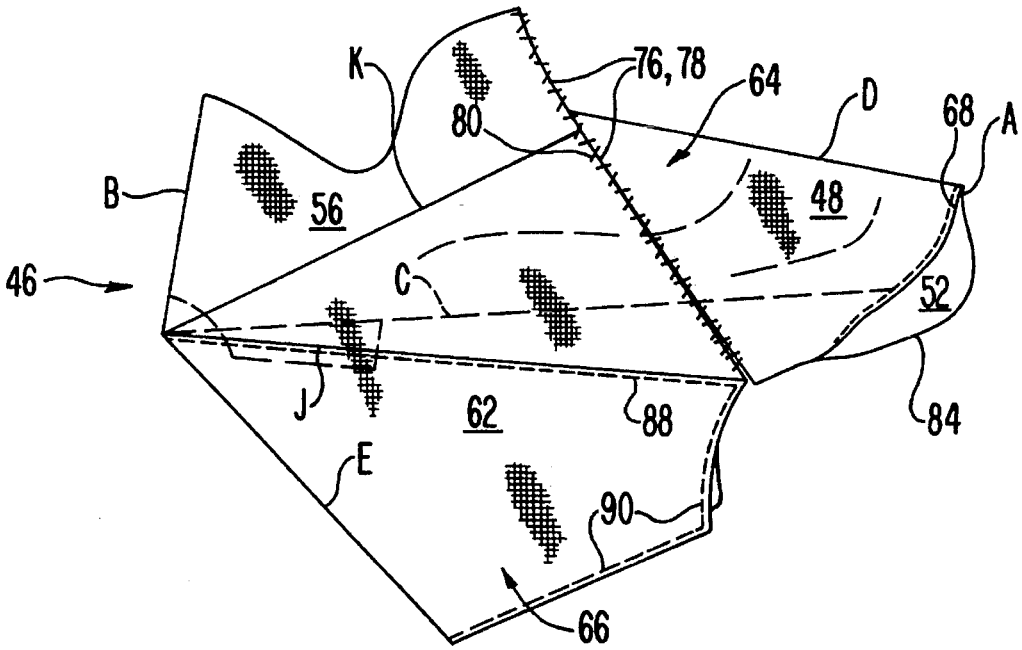
Figure 8:
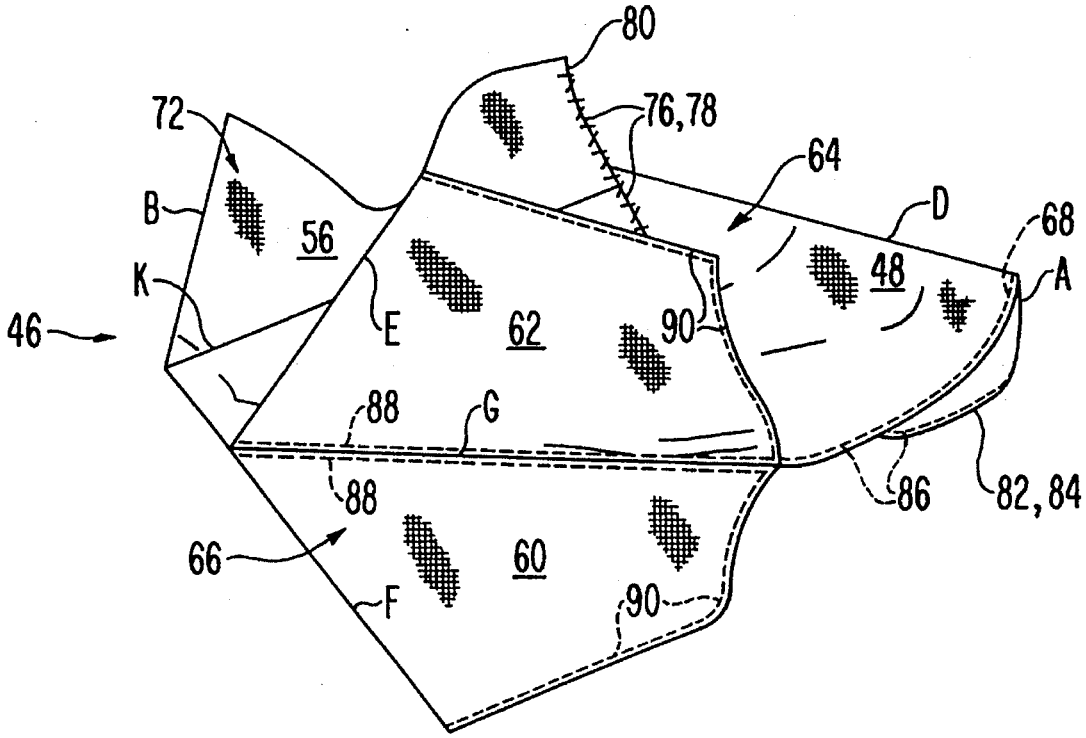

With reference to FIGS. 7–8, the forming of the bottom portion 32 of inner sleeve 22 will now be described. Blank bottom portion 58 is folded upward towards blank toe portion 48 generally along fold lines E and F. Further, as shown in FIG. 7, fold line C is inverted from its position in FIG. 6 such that the two halves of top surface 72 of blank 46 in blank bottom portion 58 overlap one another. Thus, one half of blank wing portion 60 is brought into an overlying relationship with the other half of blank wing portion 60, and one half of blank wing portion 62 is brought into an overlying relationship with the other half of blank wing portion 62. Additionally, one half of blank bottom portion 58 is brought into an overlying relationship with the other half of blank bottom portion 58 such that the two halves of top surface 72 of blank 46 in blank bottom portion 58 are in an overlying relationship upon each other. Blank bottom portion 58 is generally folded in a direction parallel to the longitudinal center line of the forming upper 20. Blank bottom portion 58 is generally folded along the portions of fold lines E and F which are adjacent the portion of blank 46 which forms the heel portion 30 of inner sleeve 22. Thus, a fold area is located generally between the portions of blank 46 used to form the heel portion 26 and the bottom portion 32 of upper 20. When blank bottom portion 58 is folded upwards, it is placed in an adjacent or juxtaposed relationship to the bottom of heel portion 30, the bottoms of side portions 28, and the bottom of toe portion 26 of inner sleeve 22.

With reference to FIG. 3, blank bottom portion 58 has an outer edge 82. In FIG. 3, edge 82 is located generally on the left side of blank bottom portion 58. Edge 82 will generally correspond to that edge of bottom portion 32 of upper 20 disposed below and adjacent to toe portion 26. With reference to FIGS. 3 and 4, blank toe portion 48 with projection 52 stitched thereon has a curved edge 84. As noted above and as shown in FIGS. 6–7, edge 84 is double backed over stitch line 68. As shown in FIG. 8, edge 82 of blank bottom portion 58 is brought into an adjacent or juxtaposed relationship with this edge 84. Edge 82 and edge 84 can then be joined together along line 86. The joining of edges 82 and 84 may be carded out in any conventional manner known to those of ordinary skill in the art. For example, a stitch line 86 of any suitable type may be used, such as a merrow or zigzag stitch.

With reference to FIG. 7, with blank 46 in this folded condition, fold lines H and I are generally aligned with one another and fold lines G and J are generally aligned with one another. While only fold line J is visible in the lateral side view shown in FIG. 7, fold lines G, H, and I are in substantial alignment therewith. With further reference to FIG. 7, stitch line 88 is used to attach bottom blank portion 58 to the lateral side portion 28, and another identical stitch line 88 (not shown) is used to stitch blank bottom portion 58 to medial side portion 28. Stitch line 88 generally runs along fold lines G and J on the lateral side of the shoe and fold lines H and I on the medial side of the shoe. Stitch lines 88 thus generally connect and extend along fold lines G, H, I and J of blank 46.

With additional reference to FIG. 7, blank lateral wing portion 62 is generally overlapped upon itself along fold line E, and blank medial wing portion 60 is generally overlapped upon itself along fold line F (not shown in FIG. 7). Thus, wing portions 24 of upper 20 are formed from blank wing portions 60, 62 having a double layer construction. This double layer construction of wing portions 24 can be held in position by stitch line 90 on each of the wing portions. Stitch line 90 can be of any suitable type, for example a straight or zigzag stitch.

Figure 9:
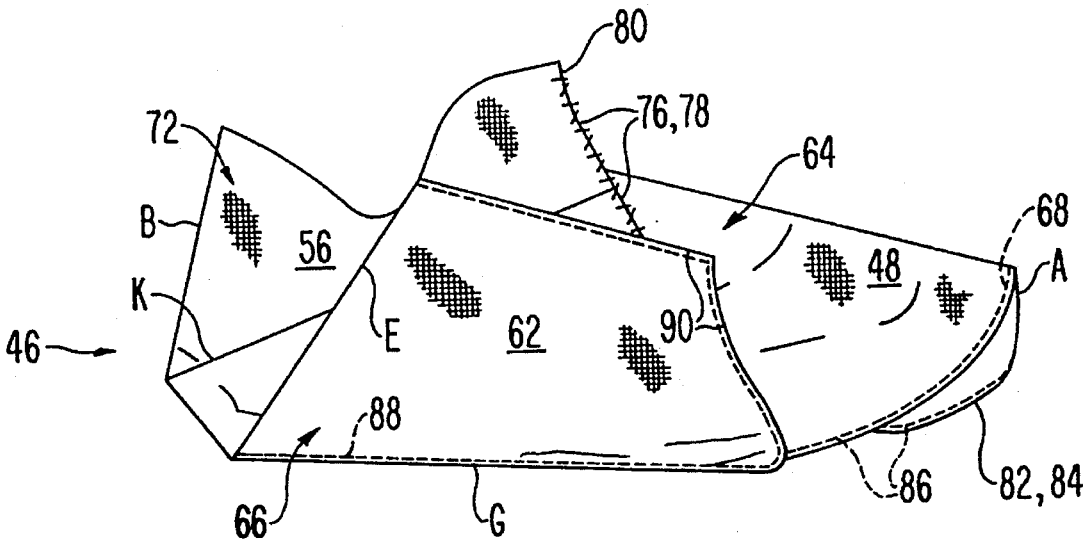

With reference to FIG. 8, blank lateral wing portion 62 is then folded upward along fold lines G and J to form lateral wing portion 24. With reference to FIG. 9, blank medial wing portion 60 is folded upwards along fold lines H and I to form medial wing portion 24. Thus, wing portions 24 of upper 20 are in a juxtaposed or overlying relationship generally with respect to the medial and lateral side portions 28 of inner sleeve 22.

With reference to FIG. 1, eyelets 36 and lacing 38 may then be added to the upper edges of wing portions 24. The upper is then ready to be attached to sole 40 as shown in FIG. 2 and as described above.

As is apparent, blank 46 may be uniformly comprised of a single material, or alternatively may be comprised of two separate materials. For example, with reference to FIG. 3, first section 64 of blank 46 can be made of an elastic material, and second section 66 of blank 46 can be made of a substantially inelastic material. Thus, fold lines I and J would generally be disposed in the area where the material would change from elastic to inelastic. As described above, first section 64 is used to form the toe portion 26, side portions 28 and heel portion 30 of inner sleeve 22, and second section 66 is used to form the bottom portion 32 of inner sleeve 22 and the wing portions 24. Thus, the resulting shoe upper 20 formed from blank 46 will have an inner sleeve 22 comprised mostly of an elastic material, and wing portions 24 comprised of an inelastic material. This structure, as described above, provides for a foot enveloping and snug fit because of the inner sleeve 22 being made mostly of an elastic material and further provides for firm support and secure attachment of a wearer's foot to a shoe because of the inelastic material of wing portions 24. As is apparent, other combinations of different materials can be used when forming blank 46 such that the resulting upper 20 formed from blank 46 can have various portions made of different materials.

As described above, during the folding and stitching operations of blank 46 to form upper 20, the blank can always be maintained in a semi-flat condition such that automated stitching can be used, thus reducing labor costs. Additionally, as described above, all components of the shoe upper can be added to blank 46 before most of the folding and stitching operations take place. The above described invention provides for a simple and effective way to produce and form a shoe upper from a blank of material. The folding and stitching operations described above are conducive to being performed by automated stitching machines such that the manufacture of shoe uppers can be greatly simplified.

Numerous characteristics and advantages of the invention have been set forth in the foregoing description, together with details of the structure and function of the invention. The disclosure, however, is illustrative only, and changes may be made in detail, especially in matters of shape, size and arrangement of the parts within the principle of the invention to the full extent indicated by the broad general meaning of the terms in which the appended claims are expressed.

What is claimed is:

1. A blank of material for forming a shoe upper, said blank comprising:

a first section including a heel portion adapted to wrap around the heel of a foot, medial and lateral side portions adapted to cover the medial and lateral sides of a foot, and a toe portion adapted to cover the toes of a foot;

a second section extending from one side of said first section and including a bottom portion adapted to underlie the bottom of a foot, said bottom portion having medial and lateral sides and being generally in alignment with and extending from said heel portion of said first section; and a fold area located between said heel portion and said bottom portion about which said first and second sections are folded to place said bottom portion in contact with said heel portion, said medial and lateral side portions and said toe portion;

wherein said second section includes a wing portion on at least one of the medial and lateral sides of said bottom portion, said wing portion being foldable upward from said bottom portion to overlay one of said side portions of said first section.

2. The blank of claim 1 wherein said toe portion of said first section further includes a projecting portion extending asymmetrically from said first section in a direction generally transverse to a direction in which said second section extends.

3. The blank of claim 1 wherein said wing portion is formed on each of said medial and lateral sides of said bottom portion.

4. The blank of claim 3 wherein said wing portion is joined to both said first and second sections, said wing portion including a middle fold line whereby in its folded condition said wing portion forms a double layered overlay.

5. The shoe upper of claim 3 wherein said wing portions are each joined to both said first and second sections along a fold line and each wing portion includes a middle fold line whereby in their folded condition each said wing portion forms a double layered overlay.

6. The blank of claim 1 wherein said first and second sections are formed from a single piece of material.

7. The blank of claim 6 wherein said single piece of material is elastic.

8. The blank of claim 1 wherein said first and second sections are formed from separate pieces of material joined to one another.

9. The blank of claim 8 wherein the material of said first section is substantially elastic and the material of said second section is substantially non-elastic.

10. A method for making a shoe upper from a blank of material comprising the steps of:

forming a blank of material into a configuration having a first section and a second section;

connecting one end of said first section to the other end of said first section to form a toe portion, a heel portion, and a pair of side portions of the upper from said first section;

folding said second section about a fold area in the area of said heel portion of said first section such that a bottom portion of the upper formed in said second section is juxtaposed with the bottom of said toe portion, the bottom of said heel portion and the bottoms of said pair of side portions;

folding a portion of said second section into a position juxtaposed to and outside of one of said side portions to form a wing portion of the upper; and connecting medial and lateral sides of said bottom portion of said second section to the bottom of said toe portion, the bottom of said heel portion and the bottoms of said pair of side portions of said first section to form a foot enclosing upper.

11. The method of claim 10 wherein said blank is formed by connecting two different types of material.

12. The method of claim 10 wherein said first section of said blank is formed in an asymmetrical configuration.

13. The method of claim 10 wherein two of said wing portions are formed.

14. The method of claim 10 further comprising the step of folding a portion of said first section onto the remaining portions of said first section such that a reinforced toe portion is formed.

15. A method of making a shoe upper comprising the steps of:

forming a single blank of material having a first section and a second section, the first section including a heel portion adapted to wrap around the heel of a foot when placed within the upper, medial and lateral side portions adapted to cover the medial and lateral sides of a foot when placed within the upper, a toe portion adapted to cover the toes of a foot when placed within the upper, and opposite ends, and the second section extending from one side of the first section, the second section including a bottom portion adapted to underlie the bottom of a foot when placed within the upper, medial and lateral side portions, and at least one wing portion extending from at least one side of the bottom portion;

folding the first section to bring the opposite ends in juxtaposition;

connecting the opposite ends of the first section to one another;

folding the second section with respect to the first section about a fold area in the area of the heel portion to juxtapose the heel portion, medial and lateral side portions and toe portion of the first section on the bottom portion of the second section;

folding the at least one wing portion of the second section upward from the bottom portion; and connecting the medial and lateral side portions of the second section to the heel portion, medial and lateral side portions and toe portion of the first section.

16. The method of claim 15 wherein a pair of said wing portions are formed on said blank, one of said wing portions extending from a medial side of said bottom portion and being folded upward therefrom, and the other of said wing portions extending from a lateral side of said bottom portion and being folded upward therefrom.

17. A method for making a shoe upper from a blank of material comprising the steps of:

forming a blank of material into a configuration having a first section and a second section;

connecting one end of said first section to the other end of said first section to form a toe portion, a heel portion, and a pair of side portions of the upper from said first section;

folding a portion of said first section onto the remaining portions of said first section such that a reinforced toe portion is formed;

folding said second section about a fold area in the area of said heel portion of said first section such that a bottom portion of the upper formed in said second section is juxtaposed to the bottom of said toe portion, the bottom of said heel portion and the bottoms of said pair of side portions; and connecting medial and lateral sides of said bottom portion of said second section to the bottom of said toe portion, the bottom of said heel portion and the bottoms of said pair of side portions of said first section to form a foot enclosing upper.

18. The method of claim 17 wherein said blank is formed by connecting two different types of material.

19. The method of claim 17 wherein said first section of said blank is formed in an asymmetrical configuration.

20. The method of claim 17 further comprising the step of folding a portion of said second section into a position juxtaposed to and outside of one of said side portions to form a wing portion of the upper.

21. The method of claim 20 wherein two of said wing portions are formed.

* * * * *